US005370498A

United States Patent [19]

Klingler

[11] Patent Number: 5,370,498

[45] Date of Patent: Dec. 6, 1994

[54] APPARATUS FOR ELIMINATION OF GAS CONSTITUENTS

[75] Inventor: Armin Klingler, Augsburg, Germany

[73] Assignee: Rational GmbH, Landsberg, Germany

[21] Appl. No.: 25,999

[22] Filed: Mar. 4, 1993

[30] Foreign Application Priority Data

Mar. 4, 1992 [DE] Germany ..... 4206847
Feb. 25, 1993 [EP] European Pat. Off. ..... 93 102 950.8

[51] Int. Cl.[5] ..... F01D 9/00

[52] U.S. Cl. ..... 415/223; 415/208.2; 95/261; 96/196

[58] Field of Search ..... 415/223, 208.1, 208.2, 415/208.3; 126/299 E; 95/260, 261; 96/177, 193, 194, 195, 196

[56] References Cited

U.S. PATENT DOCUMENTS 2,564,765 8/1951 Mercier ..... 96/177
4,274,845 6/1981 Howard ..... 126/299 E
5,076,070 12/1991 Takushima et al. ..... 415/223
5,266,160 11/1993 Henricson et al. ..... 95/261

FOREIGN PATENT DOCUMENTS 2103593 7/1982 Germany .
8534653.5 3/1986 Germany .
297652 12/1987 Japan ..... 126/299 E

*Primary Examiner*—John T. Kwon
*Attorney, Agent, or Firm*—Hill, Steadman & Simpson

[57] ABSTRACT

An apparatus for eliminating gas constituents, such as moisture or the like, from a cooking space of an industrial kitchen apparatus or the like, has a radial fan which is arranged close to an essentially vertically housing wall, the drive shaft of the radial fan penetrating the housing wall, and the housing wall having a housing opening close to the circumference of the radial fan with a partition provided close to the circumference of the radial fan for deflecting a part of the flow generated by the fan into the housing opening.

15 Claims, 3 Drawing Sheets

APPARATUS FOR ELIMINATION OF GAS CONSTITUENTS

BACKGROUND OF THE INVENTION

The present invention is directed to an apparatus for the elimination of gas constituents, such as moisture or the like, from a cooking space of an industrial kitchen apparatus or the like, wherein a radial fan having a drive shaft penetrating through an essentially vertical housing wall is arranged close to the wall.

An excess of moisture can occur, particularly when cooking food containing a great deal of water, whose water partially emerges into the atmosphere of the cooking space. Since, for example, this excess of moisture prevents the formation of crust on the food to be cooked, the excess moisture is frequently considered undesirable. There is, therefore, a necessity to eliminate the occurring moisture, at least from time to time.

The actual possibility of removing the moistures are limited. Since the reproducible qualities cannot be guaranteed, a simple measure, such as the regular opening of the door of the cooking space, is unacceptable for an industrial kitchen. Simple exhausts via chimneys provided at the cooking space also suffers from the same deficiency. The measures that are additionally undertaken, such as exhaust devices or the like, require an increased outlay for the apparatus or equipment.

German Patent 21 03 593 discloses a vapor exhaust hood for a kitchen, wherein an essentially radially-directed flow is produced in a gas volume present in a vapor exhaust hood. The radial blower is thereby partially surrounded by a guide surface, wherein the housing wall is provided onto which the gas flow in the vapor exhaust hood is directed with a partition serving as a baffle. It is not possible to eliminate a single gas constituent, such as moisture or the like, that is present in excess from the gas volume with this apparatus.

German GM 85 34 653 discloses a shut-off means for an exhaust system, wherein the suction pipe can be closed in the non-operating condition. This is thereby not a matter of an apparatus that could be employed in a kitchen device or the like for extracting, for example, excess moisture from the cooking space atmosphere.

SUMMARY OF THE INVENTION

The object of the present invention is to improve an apparatus for removing moisture, which apparatus can regulate the content of the gas constituent, such as moisture, in a simple manner.

This object is inventively achieved in that the housing wall comprises a housing opening close to the circumference of the radial fan and in that a partition for deflecting a part of the flow generated by the fan into the housing opening is provided close to the circumference of the radial fan.

It can thereby be provided that the radial fan is at least partially surrounded by a guide surface that comprises a baffle region adjacent to the housing opening. It can also be provided in the invention that the guide surface is essentially annularly fashioned.

In a further embodiment of the invention, the guide surface has the form of a hollow truncated cone that expands in a direction toward the housing wall. In addition, the guide surface may be arranged around the entire circumference of the fan, but will cover only a portion of the axial extent of the fan.

It may also be provided in the invention that the housing opening can be at least partially opened and/or closed, dependent on the content of the excess constituents in the gas.

In another embodiment of the invention, a closing means for the opening is provided and the closing means can be at least one flap, a lamellar shutter, a closure like an iris diaphragm or the like. It can also be provided that the flap is guided in a rail. The closing device can be a flap that has a cleat which is received in sliding fashion in a shaft for guiding the flap.

in the invention, a shaft will be inclined relative to the housing wall, wherein the housing opening is provided and the shaft will receive a discharge from the housing opening.

It is also possible to provide a partition which is centrally arranged with reference to the housing opening. The partition is fashioned as a partial annular surface which projects from the essentially circular housing opening on a side lying radially outward with reference to the rotational axis of the radial fan in the direction toward the radial fan. The partition can be essentially planar fashioned and proceed in a radial direction of the radial fan. It is also possible that the partition is fashioned to have a plowshare-like structure, wherein the edges of the share lie in a plane containing the axis of the radial fan and the surfaces of the share proceed divergently outward with reference to the rotational axis of the radial fan.

Finally, it is also provided in the invention that the housing opening is at least partially swept by the radial fan.

In the apparatus of the invention, the fan generates a gas flow, potentially on the inside of the provided guide surface, that is directed in accordance with the rotational sense. Particularly given employment of a cooking apparatus, the rotational sense of the fan can be changed at regular chronological intervals, so that the direction of the gas flow also correspondingly changes. Two gas streams circling at the guide surface in alternation are thus generated. The gas is thereby pressed against the partition in the baffle region and can be eliminated from the housing through the housing opening into the shaft.

When a control is desirable, it can be provided that the housing opening can at least be partially opened and/or closed, dependent on the content of the excess constituent in the gas. For example, the control can be implemented in a known manner.

Fundamentally, it is not necessary that the guide surface is guided around the entire circumference of the fan, as long as it is merely assured that the flow having the desired properties is formed. However, it can be advantageous to arrange the guide surface around the entire circumference of the fan, but at most, only partially covering the fan in its axial direction.

At least one flap, a lamellar shutter, a closure in the fashion of an iris diaphragm or the like can be provided as a closing means for the housing opening. The possibility is thereby present for the arrangement of the flap to either arrange it vertically displaceable or, on the other hand, to provide that two flaps move toward or away from one another in the fashion of a double-wing sliding door.

The elimination of the gas with the gas constituent to be removed occurs efficiently when the apparatus comprises a shaft which is inclined relative to the housing wall and in which the housing opening is provided. This shaft has a section into which the housing opening discharges.

In order to be able to close the opening essentially gas-tight, the flap can be guided in correspondingly fashioned rails. When a cleat is used for guiding a flap in the shaft in a sliding fashion, it is also attached to the flap. It can also be achieved that a contact pressure of the flap against the opening area is exerted, for example, due to the inherent elasticity of the cleat or to a spring which is additionally provided between the cleat and a portion of the shaft wall.

Finally, it is especially preferred for a fan having changing rotation sense when the partition is centrally arranged with reference to the housing opening for steering the gas flow from the guide surface to the housing opening in the baffle region.

Let it be pointed out that a critical feature of the idea of the invention is that the gas flow can be directed into the housing opening to the desired extent with the partition serving as an aerodynamic baffle, even when no guide surface surrounding the radial fan is provided, so that, for example, moisture can be removed as needed from the cooking space atmosphere or the like together with the separated gas volume.

Other advantages and features of the invention will be readily apparent from the following description of the preferred embodiments, the drawings and claims.

DESCRIPTION OF THE PREFERRED EMBODIMENTS

Figure 1:
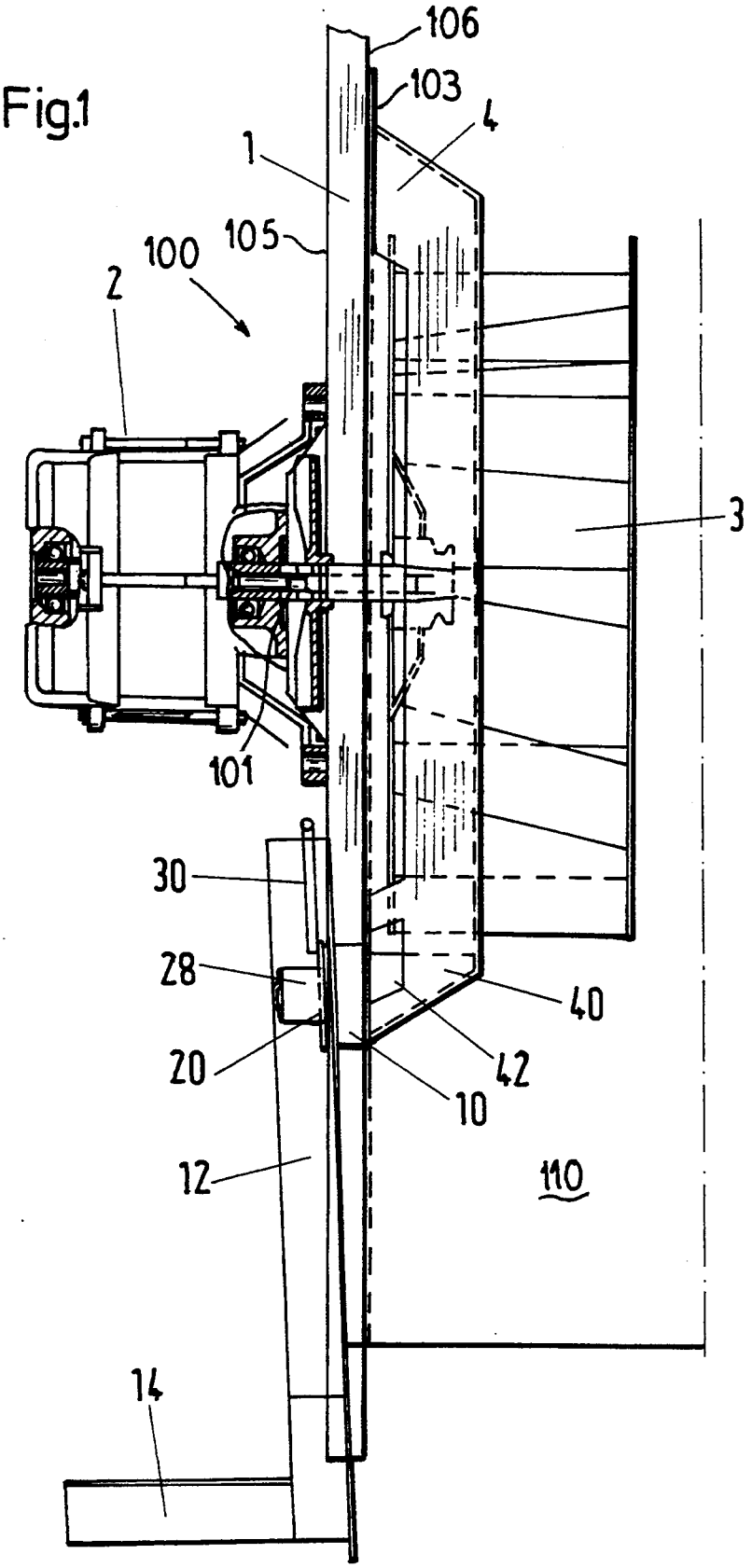
FIG. 1 is a schematic side illustration with portions in cross section for purposes of illustration of an apparatus of the present invention.
Figure 3:
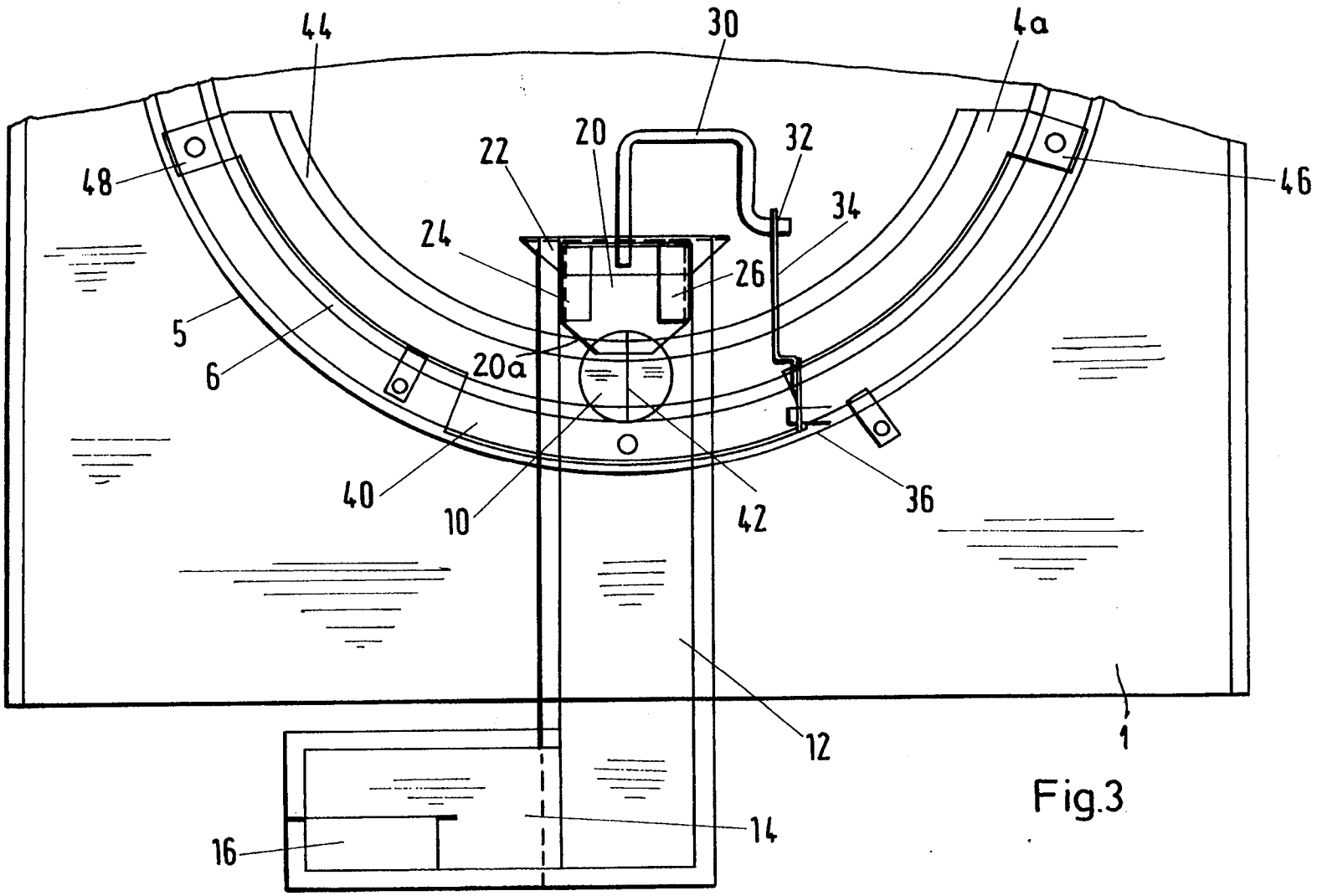
FIG. 3 is a schematic back elevational view of the device of FIG. 2.

The principles of the present invention are particularly useful in an apparatus generally indicated at 100 in FIG. 1 for eliminating a gas constituent, such as moisture or the like, from a cooking space of an industrial kitchen apparatus. The apparatus 100 includes a motor 2 which is attached on an outer surface or side 105 of a housing wall 1 and has a shaft 101 which projects through the housing wall into the interior 110 of the housing, which would be on the right side of the housing wall 1 of FIG. 1. The shaft 101 has a fan wheel 3 attached to it which extends into the interior of the housing. A guide surface 4 is provided concentrically to surround the fan wheel 3, and this guide surface 4, in the exemplary embodiment illustrated, is partially terminated on an edge or side 103 by an inner surface 106 of the housing wall 1. In a lower region of the guide surface 4, a baffle region 40 is provided and lies opposite a housing opening 10 in the housing wall 1. The housing opening 10, as best illustrated in FIG. 3, can be closed by means for closing, such as a flap 20, that can be moved via a lever mechanism in which one stirrup 30 is shown. A shaft 12 is in communication with a housing opening 10 and is provided to be inclined slightly inward in the direction toward the housing relative to the housing wall 1. The flap 20 moves within the shaft 12 and is provided with a cleat 28 (FIG. 1), which is supported in the shaft wall of the shaft 12. The shaft 12 discharges into an outlet 14. The outlet 14 essentially extends perpendicular relative to the shaft 12 so that moisture precipitating in the shaft 12 can run down under its own force of gravity. As illustrated in FIG. 3, the outlet 14 has an opening 16.

Figure 2:
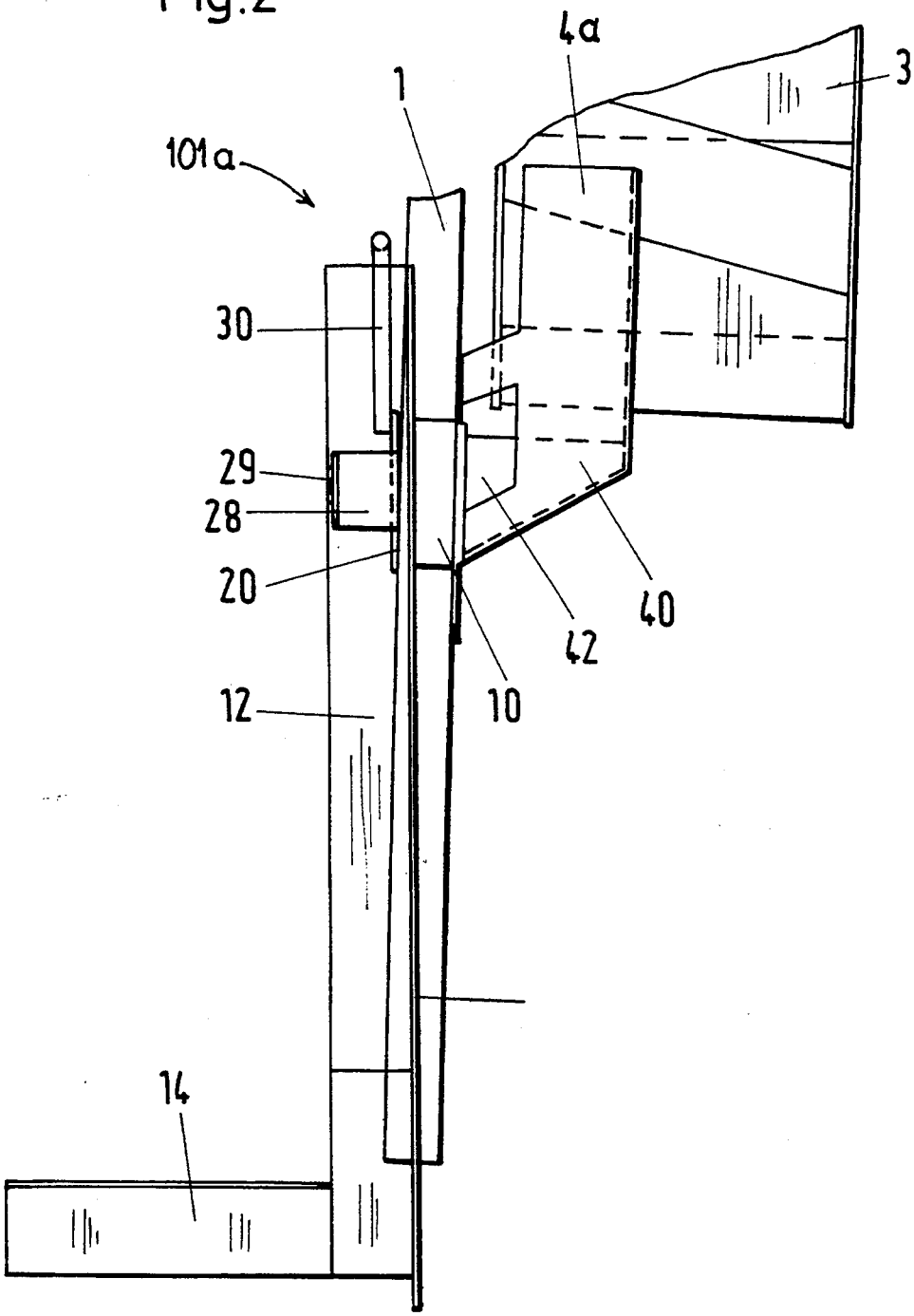
FIG. 2 is a schematic side illustration with portions in cross section for purposes of illustration of a second embodiment of the apparatus according to the present invention.

In FIG. 2, an embodiment 101*a* is generally indicated. In this embodiment, a guide surface 4*a* is constructed so that it only surrounds the fan wheel 3 in the lower region. Otherwise, the structure of the embodiment 101*a* corresponds to that of the structure 100 of FIG. 1. It may be seen particularly clear here how a spring 29 is provided to act on the cleat 28, which is attached to the flap 20 to insure a pressure seating of the flap 20 against the wall portion surrounding the opening 10.

As best illustrated in FIG. 3, the guide surface 4*a* has a folded-over fold or hem 44 on its side directed toward the center of the arrangement. This fold 44 effects a further concentration of the gas flow on the inside of the guide surface 4*a*. A partition 42 is arranged in an essentially vertical direction or plane on the guide surface 4*a* opposite the housing opening 10. The flow generated by the fan wheel, which is not shown in FIG. 3, will propagate along the guide surface 4*a* and be deflected at the partition 42 into a direction toward the housing opening 10. The guide surface 4*a* is secured to the housing wall with flanges 46 and 48 and, in addition, fastening possibilities can be provided in the baffle region 40.

In the embodiment illustrated here, in accordance herewith, the apparatus can be employed with a cooking device so that heating coils, such as 5 and 6, are arranged outside of the guide surface 4 on the inner surface of the wall 1. The flap 20 is connected to a stirrup 30 of a lever mechanism. The stirrup 30 is attached by an articulation connection 32 to a link 34 which is connected to a rodding or other required mechanism 36. The entire control, which may be either mechanical or electronic, can thus be arranged outside the housing in which the gas volume is located. The gliding aid 22 for the flap 20 is provided in the upper region of the shaft 12. The flap itself terminates with a trapezoidal end 20*a*. The flap can be lowered to a greater or lesser extent into the shaft 12 with the mechanism guided in the rails 24 and 26, wherein the housing opening 10 is opened to a greater or lesser degree in accordance with the prescribed specification. Since the shaft 12 is generally at a lower temperature than the heated inside of the housing, the moisture precipitates out in the shaft and trickles into the outlet 14, where it can drain from the latter via the opening 16.

The mechanism for lifting and lowering the flap 20 must be designed so that it can assure the malfunction-free functioning of the apparatus. However, there is no necessity of the limitations to the embodiment shown in FIG. 3.

This apparatus 100 or 100*a* is preferably utilized for controlling the moisture content of the cooking space atmosphere. As soon as an excessively high moisture content is identified, the flap 20 is opened, whereby the pressure built up by the guide surface 4 or 4*a* will force the elimination of the cooking space atmosphere. The dry, replenishing air lowers the moisture content on the inside of the cooking space. If the moisture content is to remain constant or if it is ever to be elevated, the flap can be closed. Measures can be provided as needed that make it possible to designationally supply moisture to the interior of the cooking space.

Although various minor modifications may be suggested by those versed in the art, it should be understood that I wish to embody within the scope of the patent granted hereon all such modifications as reasonably and properly come within the scope of my contribution to the art.

I claim:

1. An apparatus for eliminating gas constituents, including moisture, from a cooking space of an industrial kitchen appliance having a housing wall, said apparatus comprising a radial fan on a drive shaft penetrating the housing wall with the fan arranged close to the housing wall, said housing wall having a housing opening close to a circumference of the radial fan, and a partition being positioned on the housing wall close to the circumference of the radial fan and adjacent the housing opening of the housing wall for deflecting flow generated by the fan into the housing opening.

2. An apparatus according to claim 1, wherein the radial fan is at least partially surrounded by a guide surface that includes a baffle region adjacent to the housing opening.

3. An apparatus according to claim 2, wherein the guide surface has an essentially an annular shape.

4. An apparatus according to claim 2, wherein the guide surface has a shape of a hollow truncated cone which expands in the direction toward the housing wall.

5. An apparatus according to claim 2, wherein the guide surface is arranged around the entire circumference of the redial fan and extends only partially over the axial length of the fan.

6. An apparatus according to claim 1, which includes means for closing the housing opening to control the amount of gas being directed therethrough.

7. An apparatus according to claim 6, wherein the means for closing is selected to include at least one flap, a lamellar shutter, and a closure in the fashion of an iris diaphragm.

8. An apparatus according to claim 6, wherein the means for closing is a flap guided on rails.

9. An apparatus according to claim 6, which includes a shaft being positioned on the housing wall opposite the surface facing the fan and having a portion surrounding said housing opening, said means being a flap having a cleat secured thereto, said cleat guiding the flap for movement in said shaft in a sliding fashion.

10. An apparatus according to claim 1, which includes a shaft inclined relative to the housing wall, said shaft being positioned on an outer surface of the housing wall opposite the fan and surrounding the housing opening, said shaft having a discharge outlet.

11. An apparatus according to claim 1, wherein the partition is centrally arranged with reference to the housing opening.

12. An apparatus according to claim 1, wherein the partition is fashioned as a partially annular surface projecting in the direction toward the radial fan from the essentially circular housing opening at a side lying radially outward with reference to the rotational axis of the radial fan.

13. An apparatus according to claim 1, wherein the partition is fashioned essentially planar and proceeds in a radial direction of the radial fan.

14. An apparatus according to claim 1, wherein the partition is fashioned in the manner of a plowshare, with share edges lying in a plane containing an axis of the radial fan and the share surfaces proceeding divergently outward with reference to the rotational axis of the radial fan.

15. An apparatus according to claim 1, wherein the housing opening is at least partially swept by the radial fan.

* * * * *